US005564206A

United States Patent [19]

Ruvang

[11] Patent Number: 5,564,206

[45] Date of Patent: Oct. 15, 1996

[54] SELF-ADJUSTING TOOTH/ADAPTER CONNECTION SYSTEM FOR MATERIAL DISPLACEMENT APPARATUS

[75] Inventor: John A. Ruvang, Carrollton, Tex.

[73] Assignee: GH Hensley Industries, Inc., Dallas, Tex.

[21] Appl. No.: 556,701

[22] Filed: Nov. 13, 1995

[51] Int. Cl.[6] ..... E02F 9/28

[52] U.S. Cl. ..... 37/458; 37/457; 37/456; 37/455; 411/368; 411/544

[58] Field of Search ..... 37/458, 455, 456, 37/457; 411/368, 147, 955, 544

[56] References Cited

U.S. PATENT DOCUMENTS

| | | | |
|---|---|---|---|
| 943,775 | 12/1909 | Exton et al. . | |
| 1,021,135 | 3/1912 | Clark . | |
| 1,188,480 | 6/1916 | Pemberton . | |
| 1,548,374 | 8/1925 | Mullally . | |
| 1,571,782 | 2/1926 | Andrews | 37/455 |
| 1,787,695 | 1/1931 | McKee | 37/455 |
| 1,870,044 | 8/1932 | Fellmeth | 37/455 |
| 1,917,431 | 7/1933 | Clark . | |
| 1,992,591 | 2/1935 | Whisler | 37/456 |
| 2,181,675 | 11/1939 | Watson | 37/191 |
| 2,688,475 | 9/1954 | Small | 37/456 X |
| 2,702,490 | 2/1955 | Launder | 85/8.3 |
| 5,205,057 | 4/1993 | Garman | 37/458 |
| 5,272,824 | 12/1993 | Cornelius | 37/458 |
| 5,410,826 | 5/1995 | Immel et al. | 37/455 |
| 5,452,529 | 9/1995 | Neuenfeldt et al. | 37/455 |

*Primary Examiner*—Randolph A. Reese
*Assistant Examiner*—Thomas A. Beach
*Attorney, Agent, or Firm*—Konneker & Smith

[57] ABSTRACT

An excavation tooth point longitudinally extending along an axis and having a pocket area extending inwardly through a rear end thereof is telescoped onto a nose portion of an adapter structure by inserting the nose portion into the tooth point pocket area. The inserted nose portion has a tapered side opening therein that is positioned between a corresponding pair of similarly tapered tooth side wall openings. To removably couple the tooth point to the adapter nose an elongated, wedge shaped connector member is inserted, small end first, through the generally aligned tooth and adapter openings. A bolt is then passed through a central opening in a flat spring member and tightened into a threaded axial opening in the small connector member end. The tightening of the bolt causes tapered side surfaces of the connector member to engage correspondingly tapered side surfaces of the tooth point and adapter openings in a manner axially tightening the tooth onto the adapter nose, and also longitudinally bends the originally straight spring member against an external side surface portion of the tooth point. The bent spring member exerts a longitudinal force on the connector member to thereby cause it to resiliently hold the tooth point in an axially tightened orientation on the adapter nose, and automatically tighten the tooth further onto the adapter nose in response to tooth/adapter interface wear that would otherwise cause undesirable "play" between the tooth point and the adapter nose portion.

9 Claims, 3 Drawing Sheets

SELF-ADJUSTING TOOTH/ADAPTER CONNECTION SYSTEM FOR MATERIAL DISPLACEMENT APPARATUS

BACKGROUND OF THE INVENTION

The present invention generally relates to material displacement apparatus and, in a preferred embodiment thereof, more particularly relates to apparatus for releasably coupling a replaceable excavation tooth point to an associated adapter nose structure.

A variety of types of material displacement apparatus are provided with replaceable portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interengageable elements adjacent the rear end of the point, and a suitable connector structure is driven into and forcibly retained within the aligned openings to releasably anchor the replaceable tooth point on its associated adapter nose portion.

These connector structures adapted to be driven into the aligned tooth point and adapter nose openings typically come in two primary forms—(1) wedge and spool connector sets, and (2) flex pin connectors. A wedge and spool connector set comprises a tapered spool portion which is initially placed in the aligned tooth and adapter nose openings, and a tapered wedge portion which is subsequently driven into the openings, against the spool portion, to jam the structure in place within the openings in a manner exerting high rigid retention forces on the interior opening surfaces and press the nose portion into a tight fitting engagement with the tooth socket.

Very high drive-in and knock-out forces are required to insert and later remove the steel wedge and typically require a two man effort to pound the wedge in and out—one man holding a removal tool against an end of the wedge, and the other man pounding on the removal tool with a sledge hammer. This creates a safety hazard due to the possibility of flying metal slivers and/or the second man hitting the first man instead of the removal tool with the sledge hammer. Additionally, wear between the tooth/adapter nose surface interface during excavation use of the tooth tends to loosen the tight fit of the wedge/spool structure within the tooth and adapter nose openings, thereby permitting the wedge/spool structure to fall out of the openings and thus permitting the tooth to fall off the adapter nose.

Flex pin structures typically comprise two elongated metal members held in a spaced apart, side-by-side orientation by an elastomeric material bonded therebetween. The flex pin structure is longitudinally driven into the tooth and adapter nose openings to cause the elastomeric material to be compressed and resiliently force the metal members against the nose and tooth opening surfaces to retain the connector structure in place within the openings and resiliently press the adapter nose portion into tight fitting engagement with the interior surface of the tooth socket.

Flex pins also have their disadvantages. For example, compared to wedge/spool structures they have a substantially lower in-place retention force. Additionally, reverse loading on the tooth creates a gap in the tooth and adapter nose openings through which dirt can enter the tooth pocket and undesirably accelerate wear at the tooth/adapter nose surface interface which correspondingly loosens the connector retention force. Further, the elastomeric materials typically used in flex pin connectors are unavoidably subject to deterioration from hot, cold and acidic operating environments. Moreover, in both wedge-and-spool and flex pin connector structures relatively precise manufacturing dimensional tolerances are required in the tooth point and adapter nose portions to accommodate the installation of their associated connector structures.

It can be seen from the foregoing that it would be desirable to provide improved excavating tooth connector apparatus that eliminates or at least substantially reduces the above-mentioned problems, limitations and disadvantages associated with conventional excavating tooth and other material displacement equipment connector apparatus of the general type described above. It is accordingly an object of the present invention to provide such improved connector apparatus.

SUMMARY OF THE INVENTION

In carrying out principles of the present invention, in accordance with a preferred embodiment thereof, a specially designed, self-tightening material displacement tooth and adapter assembly is provided. The assembly basically comprises an adapter structure, a replaceable tooth point, and self-tightening means.

The adapter structure has a base section with a tapered nose portion projecting outwardly therefrom along a first axis, the nose portion having a tapered connector opening extending therethrough in a direction transverse to the first axis.

The replaceable tooth point, representatively an excavation tooth point, is slidably releasably telescoped on the nose portion and engages it along a tapered interface area which, in response to wear thereof, permits the tooth point to be slidably moved in a tightening direction toward the base section. The tooth point has an opposed pair of tapered side wall connector openings positioned on opposite sides of and generally aligned with the nose portion connector opening.

The self-tightening means are responsive to wear of the tooth point/nose portion interface area and are automatically operative to create movement of the tooth point in the tightening direction thereof. The self-tightening means include an elongated, generally wedge-shaped connector member longitudinally extending through the aligned tooth point and nose portion connector openings and slidably bearing on oppositely facing interior surface portions thereof. The connector member has a first end and a smaller second end spaced apart in a first direction from the first end.

Also forming a portion of the self-tightening means are force exerting means, removably secured to the second connector member end, for continuously exerting a resilient force on the connector member in the first direction in a manner causing it to urge the tooth point in the tightening direction thereof.

In a preferred embodiment thereof, the force exerting means include a bolt which is coaxially threaded into an internally threaded opening longitudinally extending into the second end of the connector member. The bolt extends through a central opening in an elongated flat spring member which is longitudinally and resiliently bent, by a head portion of the bolt, against a concavely curved exterior side surface portion of the tooth point. As tooth point/nose portion interface wear occurs during use of the assembly, the loosening of the tooth/adapter fit permits the tooth point to move along the nose portion toward the adapter base section. As this interface area loosening occurs, the bent spring member resiliently moves toward its originally straight configuration to thereby axially move the connector member and cause it to rampingly force the tooth point in a retightening direction toward the adapter base section.

According to another feature of the present invention, the interface area between the tooth point and the adapter nose has, in addition to the previously mentioned tapered portions, opposite surface portions positioned on opposite sides of and extending generally parallel to the tooth point axis. These parallel interface surface portions advantageously function to assure that if the connector member is unintentionally dislodged during use of the assembly, and the tooth point forcibly pulled off the adapter nose, the tooth point removal direction is essentially parallel to the tooth point axis, thereby preventing the tooth point from being rotated, and potentially damaging the adapter nose, as the tooth point is forced off the adapter nose.

DETAILED DESCRIPTION

Figure 1:
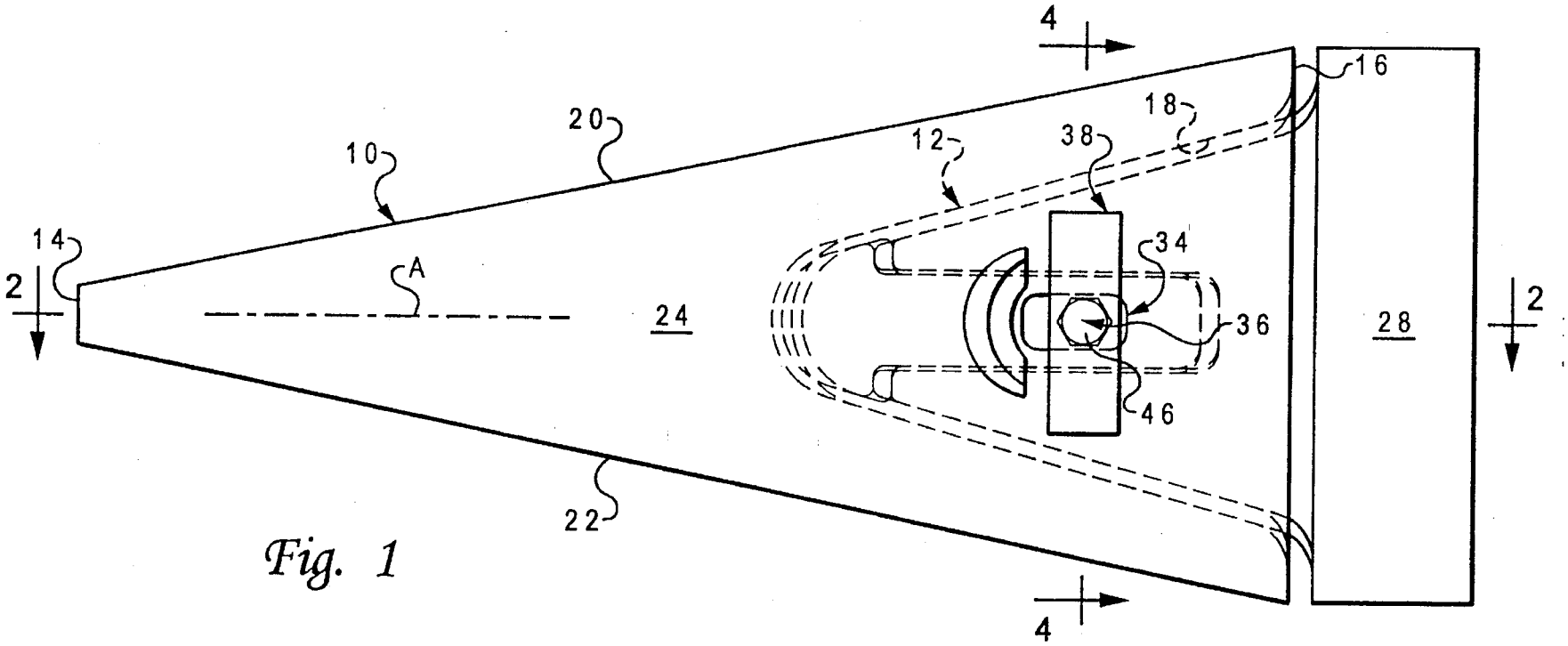
FIG. 1 is a partially phantomed side elevational view of an excavation tooth/adapter nose assembly releasably coupled by a specially designed self-adjusting connection system embodying principles of the present invention.

As illustrated in FIGS. 1–4, the present invention provides, as subsequently described in detail herein, connection apparatus for removably joining a tooth point 10 to an associated adapter nose 12 for use in a material displacement operation such as an earth excavation task.

Removable tooth point 10 has an elongated, tapered body extending along a longitudinal axis A and having a pointed outer end 14; a wider inner end 16; a pocket area 18 extending from the inner end 16 into the interior of the tooth point 10; top and bottom sides 20,22; and left and right sides 24,26. Adapter nose 12 is configured to be complementarily and removably received in the tooth pocket area 18 and projects outwardly from a suitable support lip structure 28 such as that extending along the bottom side of an earth excavation bucket.

Figure 2:
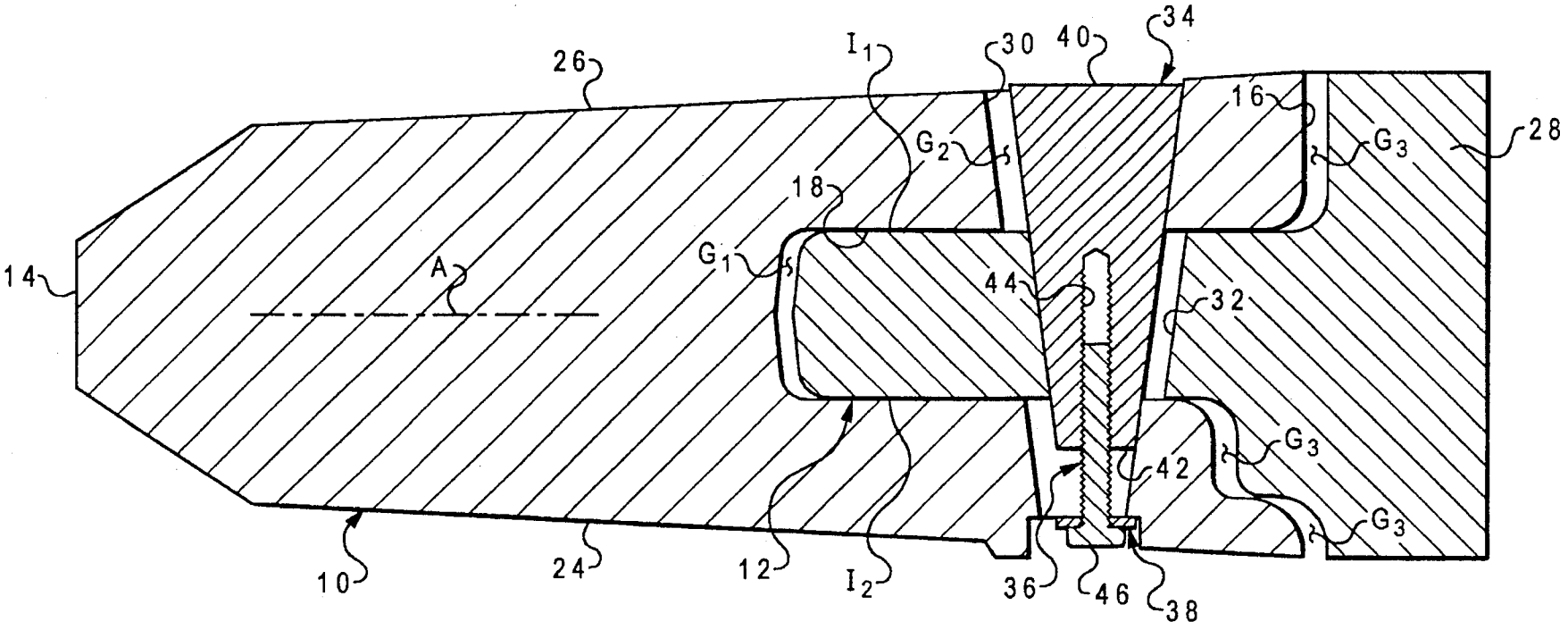
FIG. 2 is a cross-sectional view through the assembly taken along line 2—2 of FIG. 1.
Figure 3:
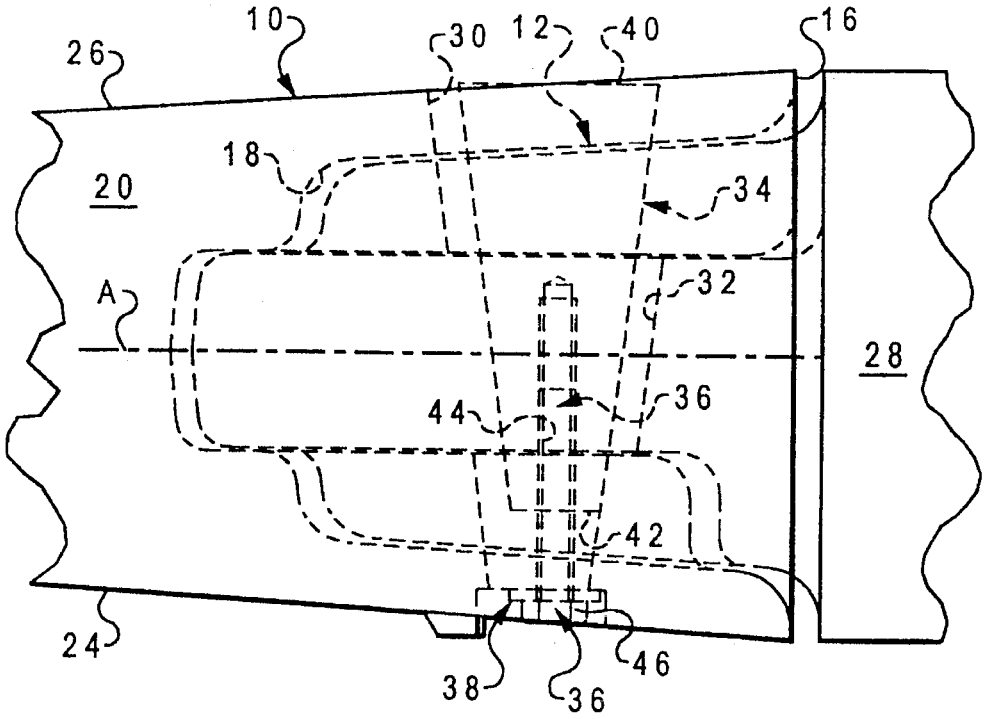
FIG. 3 is a partially phantomed partial top plan view of the assembly.

As illustrated in FIGS. 2 and 3, the tooth point 10 has, adjacent its inner end 16, a tapered connection opening 30 extending between its opposite sides 24 and 26 and intersecting its internal pocket area 18. Opening 30 tapers inwardly toward the tooth side 24 as indicated. A similarly tapered connection opening 32 is formed in the adapter nose 12. When the adapter nose 12 is operatively received in the tooth pocket 18, the adapter nose opening 32 is communicated with opposite ends of the tooth connection opening 30 but is slightly offset therefrom toward the inner end 16 of the tooth point 10

Figure 4:
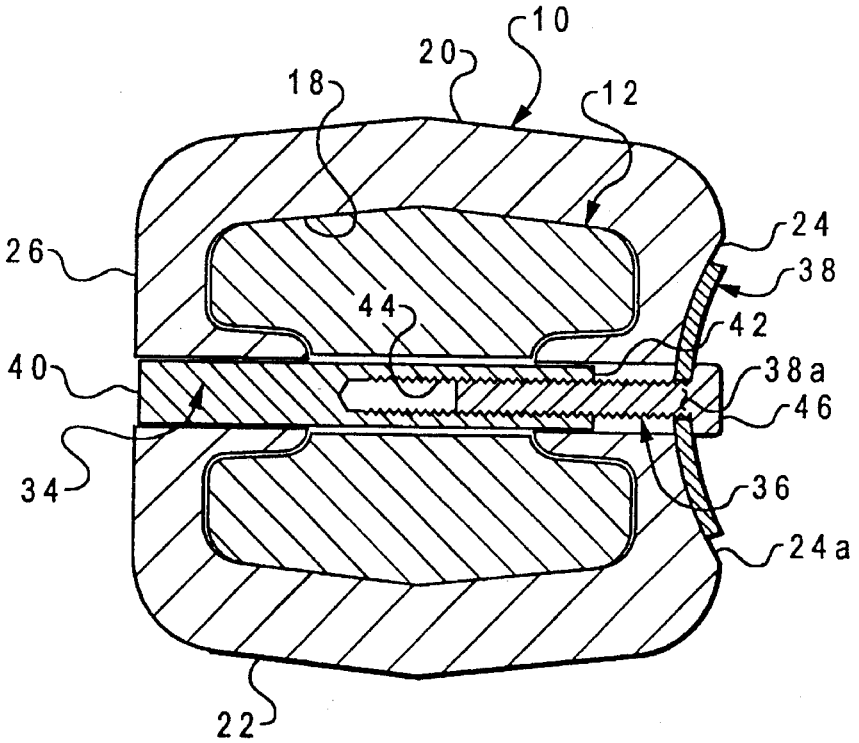
FIG. 4 is a cross-sectional view through the assembly taken along line 4—4 of FIG. 1.

The connector apparatus of the present invention has three parts—a flat, wedge shaped connector member 34; a threaded bolt member 36; and an elongated rectangular flat adjusting spring member 38. Connector member 34 has a relatively wide outer end 40, a relatively narrow inner end 42, and an internally threaded opening 44 extending inwardly through the inner end 42. Bolt 36 has an enlarged head portion 46, and the elongated body of the bolt 36 is configured to be passed through a central opening 38*a* in the flat spring member 38 as best illustrated in FIG. 4.

To removably and releasably couple the telescoped tooth point 10 and the adapter nose 12, the wedge-shaped connector member 34 is inserted end 42 first into the tapered tooth and adapter openings 30,32 through the side 26 of the tooth 10, and the inner end of the bolt 36 is inserted into the other end of the tooth opening 30 and tightened into the connector member end opening 44 as best illustrated in FIGS. 2 and 3. As the bolt 36 is tightened into the connector wedge opening 44 the connector member 34 is drawn toward the side 24 of the tooth 10, thereby forcing the tooth 10 toward the lip 28 and longitudinally "tightening" the tooth 10 against the adapter nose 12 received therein.

Additionally, the tightening of the bolt 36 into the connector member opening 44 longitudinally and resiliently bends the flat spring 38 (see FIG. 4) from its original straight orientation inwardly against a concave portion 24*a* of the outer tooth point side 24. As the surface interface area between the interior tooth pocket surface and the external adapter nose surface begins to wear, the tooth 10 tends to become progressively looser on the adapter nose 12. As this occurs, the resiliently deformed spring 38 automatically pulls the connector wedge member 12 inwardly by longitudinally straightening and thereby pulling the bolt 36 to the right as viewed in FIG. 4. This inward movement of the connector member 34 (downwardly as viewed in FIG. 2) rightwardly drives the tooth 10 on the adapter nose 12 to longitudinally "retighten" the tooth on the adapter nose and automatically compensate for operational wear at their surface interface areas.

The connector system 34,36,38 provides several advantages over conventional wedge and spool connectors and resilient flex pin connector structures. First, the connector system of this invention is a non-impact system—i.e., it does not have to be driven into place using a sledge hammer or the like. Thus it is easier and safer to install. Second, it advantageously creates rigid resistance to undesirable movement of the tooth 10 axially toward and away from the adapter lip 28. Third, it provides for substantial increases in allowable fit/shift movement between the tooth and the adapter. Fourth, compared to resilient flex pin connector structures using various elastomeric materials therein, the connector system of the present invention (being all metal) is essentially impervious to high temperature, low temperature and acidic operating conditions.

It should be noted that the previously described self-tightening action, in which driven rightward axial movement of the tooth 10 along the nose portion 12 toward the support lip structure 28 occurs due to the automatic action of the connector system 34,36 and 38, is permitted (as best illustrated in FIG. 2) by the various axial gaps $G_1$ between the left or forward end of the nose portion 12 and the inner end of the tooth pocket 18; $G_2$ between the forward or left side surface of the tapered opening 30; and the gaps $G_3$ between facing interior tooth and adapter surface portions of the assembly disposed rightwardly or rearwardly of the connector system 34,36,38. As will be appreciated, these gaps are generally as shown in FIG. 2 when the tooth point 10 is originally installed on the adapter nose portion 12, and horizontally decrease in width as tooth/adapter nose wear occurs and the tooth point 10 is automatically tightened rightwardly onto the nose portion 12 by the action of the connector structure 34,36,38.

An additional feature of the overall tooth/adapter/connector system assembly of the present invention is that, as best shown in FIG. 2, the telescoped tooth 10 and adapter nose portion 12 engage along a pair of spaced apart elongated surface interface areas $I_1$ and $I_2$ that are parallel to one another as well as being parallel to the longitudinal tooth axis A. This geometric feature of the invention advantageously eliminates bending stresses placed on the connector member 34, causing it to be loaded essentially entirely in shear in response to operational loads tending to pull the tooth 10 off the adapter nose 12.

Moreover, in the event that the connector member 34 somehow becomes dislodged from the tooth/adapter interior during use of the equipment, the tooth comes essentially straight off of the adapter (being guided in such essentially straight direction by the interface areas $I_1$ and $I_2$), thereby preventing the tooth from pivoting relative to the adapter and damaging it.

As can readily be seen from the foregoing, the connector system 34,36,38 of the present invention is of a simple, rugged construction, is relatively inexpensive to fabricate, and is quite simple, easy and safe to install in and remove from the tooth/adapter assembly. Additionally, the built-in wear compensation and tightening feature of the connector system is substantially greater than that of the typical flex pin connector, and permits a satisfactory installation fit between a new tooth point and either an essentially unworn adapter nose portion or a partially worn adapter nose portion.

The foregoing detailed description is to be clearly understood as being given by way of illustration and example only, the spirit and scope of the present invention being limited solely by the appended claims.

What is claimed is:

1. A material displacement tooth and adapter assembly comprising:

an adapter structure having a base section with a tapered nose portion projecting outwardly therefrom along a first axis, said nose portion having a tapered connector opening extending therethrough in a direction transverse to said first axis;

a replaceable tooth point slidably and releasably telescoped on said nose portion and engaging it along a tapered interface area which, in response to wear thereof, permits said tooth point to be slidably moved in a tightening direction toward said base section, said tooth point having an opposed pair of tapered side wall connector openings positioned on opposite sides of and generally aligned with said nose portion connector opening; and self-tightening means, responsive to wear of said interface area, for automatically creating movement of said tooth point in said tightening direction, said self-tightening means including:

an elongated, generally wedge-shaped connector member longitudinally extending through the aligned tooth point and nose portion connector openings and slidably bearing on oppositely facing interior surface portions thereof, said connector member having a first end and a second end smaller than said first end and spaced apart therefrom in a first direction, said second connector member end having an internally threaded opening extending longitudinally thereinto, force exerting means, removably secured to said second end of said connector member, for continuously exerting a resilient force on said connector member in said first direction in a manner causing it to urge said tooth point in said tightening direction, said force exerting means including a bolt threaded into said internally threaded opening of second connector member and tightened relative thereto about an axis parallel to the length of said connector member, said bolt having a head portion disposed externally of said tooth point and facing an exterior portion thereof, said force exerting means further including an elongated flat spring member captively retained on said bolt and being resiliently deformed between said head portion of said bolt and said exterior surface portion of said tooth portion said tooth point having a concave outer side surface through which said bolt inwardly extends, said flat spring member having a central opening through which said bolt extends, and said flat spring member being longitudinally bent by said bolt head portion against said concave outer side surface.

2. The tooth and adapter assembly of claim 1 wherein:

said tooth point is a replaceable excavation tooth point.

3. The tooth and adapter assembly of claim 1, wherein:

said interface area includes two generally planar portions positioned on opposite sides of and essentially parallel to said first axis, said generally planar portions being operative, in response to forcible axial removal of said tooth point from said nose portion, to maintain the removal direction of said tooth point generally parallel to said first axis.

4. Material displacement apparatus comprising:

a replaceable tooth point having a front end, a rear end, an adapter nose pocket extending forwardly along an axis through said rear end and circumscribed by a laterally outer wall portion of said tooth point, and an aligned pair of tapered connector openings formed through opposed sections of said laterally outer wall portion;

an adapter having a forwardly projecting nose portion removably receivable in said adapter nose pocket and engageable with the interior surface thereof along an interface area having oppositely facing tapered portions, said tooth point and said adapter being relatively configured in a manner permitting rearward axial tightening movement of said tooth point relative to said nose portion in response to tooth point/adapter nose portion wear along said tapered interface area portions, said nose portion having a tapered connector opening extending transversely therethrough which is positionable between and generally alignable with said tooth point connector openings; and self-adjusting connector apparatus for releasably retaining said adapter nose portion within said tooth point pocket and exerting a continuous, rearward axial tightening force on said tooth point so that operating wear on said opposite tapered portions of said interface area responsively creates rearward tightening movement of said tooth point along said nose portion, said connector apparatus including:

an elongated connector member having a first end, a smaller second end, and longitudinally tapered opposite side surfaces extending between said first and second ends, said connector member being longitudinally insertable, second end first, in an insertion direction into the aligned tapered connector openings in said tooth point and adapter nose portion in a manner causing said tapered opposite side surfaces of said connector member to complementarily and slidably engage opposing surface portions of said tapered connector openings in said tooth point and adapter nose portions, a resiliently deformable spring member, and a fastening member securable to said spring member and threadably engageable with said second end of said connector member, said fastening member being tightenable onto said connector member to deform said spring member against said tooth point and cause said spring member to exert, via said fastening member, a longitudinal biasing force in said insertion direction on said fastening member, said second end of said connector member having an internally threaded opening extending longitudinally thereinto, said fastening member being a bolt having a head portion and being threadable into said internally threaded opening, and said spring member being a flat spring member engageable by said bolt and resiliently compressible between said head portion thereof and an exterior surface portion of said tooth when said bolt is operatively tightened into said internally threaded opening, said spring member having an elongated configuration and a central opening therein through which said bolt may be extended before being operatively tightened into said internally threaded opening, and said tooth point having a concave outer side surface portion against which said spring member may be longitudinally bent against by said bolt head portion when said bolt is operatively tightened into said internally threaded opening in said connector member.

5. The material displacement apparatus of claim 4 wherein:

said tooth point is a replaceable excavation tooth point.

6. The material displacement apparatus of claim 4 wherein:

said interface area has oppositely disposed surface portions positioned on opposite sides of and extending parallel to said axis to thereby prevent pivoting of said tooth point about an axis perpendicular to said tooth point axis during removal of said tooth point from said nose portion.

7. A material displacement tooth and adapter assembly comprising:

an adapter structure having a base section with a tapered nose portion projecting outwardly therefrom along a first axis, said nose portion having a tapered connector opening extending therethrough in a direction transverse to said first axis;

a replaceable tooth point slidably and releasably telescoped on said nose portion and engaging it along a tapered interface area which, in response to wear thereof, permits said tooth point to be slidably moved in a tightening direction toward said base section, said tooth point having an opposed pair of tapered side wall connector openings positioned on opposite sides of and generally aligned with said nose portion connector opening, said tooth point having a concave outer side surface portion; and self-tightening means, responsive to wear of said interface area, for automatically creating movement of said tooth point in said tightening direction, said self-tightening means including:

an elongated, generally wedge-shaped connector member longitudinally extending through the aligned tooth point and nose portion connector openings and slidably bearing on oppositely facing interior surface portions thereof, a force exerting member extending inwardly through said concave outer side surface portion of said tooth point and secured to said connector member, said force exerting member having an outer end portion disposed outwardly of said concave outer side surface portion, and an elongated flat spring member having a longitudinally intermediate portion engaged by outer end portion of said force exerting member, said elongated flat spring member being resiliently deformed against said concave outer side surface by said outer end portion of said force exerting member and exerting a resilient, outwardly directed force on said force exerting member in a manner causing said connector member to urge said tooth point in said tightening direction thereof.

8. The tooth and adapter assembly of claim 7 wherein:

said tooth point is a replaceable excavation tooth point.

9. The tooth and adapter assembly of claim 7 wherein:

said interface area includes two generally planar portions positioned on opposite sides of and essentially parallel to said first axis, said generally planar portions being operative, in response to forcible axial removal of said tooth point from said nose portion, to maintain the removal direction of said tooth point generally parallel to said first axis.

* * * * *